US007789468B2

(12) United States Patent
Sollami

(10) Patent No.: US 7,789,468 B2
(45) Date of Patent: Sep. 7, 2010

(54) BIT HOLDER USABLE IN BIT BLOCKS HAVING EITHER OF A CYLINDRICAL OR NON-LOCKING TAPER BORE

(75) Inventor: Phillip Sollami, Herrin, IL (US)

(73) Assignee: The Sollami Company, Herrin, IL (US)

( * ) Notice: Subject to any disclaimer, the term of this patent is extended or adjusted under 35 U.S.C. 154(b) by 0 days.

(21) Appl. No.: 12/194,195

(22) Filed: Aug. 19, 2008

(65) Prior Publication Data

US 2010/0045094 A1 Feb. 25, 2010

(51) Int. Cl.
*E21C 35/197* (2006.01)

(52) U.S. Cl. ..... 299/107; 299/104; 299/102

(58) Field of Classification Search ..... 299/102–104, 299/106, 107, 110
See application file for complete search history.

(56) References Cited

U.S. PATENT DOCUMENTS

| | | | | |
|---|---|---|---|---|
| 3,397,012 | A | 8/1968 | Krekeler | |
| 3,865,437 | A | 2/1975 | Crosby | |
| 4,084,856 | A | 4/1978 | Emmerich et al. | |
| 4,844,550 | A | 7/1989 | Beebe | |
| 4,850,649 | A * | 7/1989 | Beach et al. | 299/107 |
| 5,067,775 | A | 11/1991 | D'Angelo | |
| 5,088,797 | A | 2/1992 | O'Neill | |
| 5,273,343 | A | 12/1993 | Ojanen | |
| 5,302,005 | A | 4/1994 | O'Neill | |
| 5,303,984 | A | 4/1994 | Ojanen | |
| 5,628,549 | A | 5/1997 | Ritchey et al. | |
| 5,725,283 | A | 3/1998 | O'Neill | |
| D420,013 | S | 2/2000 | Warren | |
| 6,176,552 | B1 | 1/2001 | Topka | |
| 6,371,567 | B1 | 4/2002 | Sollami | |
| 6,685,273 | B1 | 2/2004 | Sollami | |
| 7,118,181 | B2 * | 10/2006 | Frear | 299/104 |

FOREIGN PATENT DOCUMENTS

| | | | |
|---|---|---|---|
| DE | 19720635 | A1 * | 11/1998 |
| EP | 264015 | A * | 4/1988 |
| EP | 771911 | A1 * | 5/1997 |

* cited by examiner

*Primary Examiner*—Sunil Singh
(74) *Attorney, Agent, or Firm*—Patnaude and Videbeck

(57) ABSTRACT

A bit holder for use in a bit assembly in road milling, mining and trenching equipment has a hollow generally cylindrical shank and first and second elongate slots positioned in spaced axial relation through the shank. The first slot extends along the shank to the distal end thereof. The second slot may be altered in length and/or shape to fine tune the outward radial force the shank exerts against the bore of a bit block into which it is inserted.

4 Claims, 5 Drawing Sheets

Before insertion

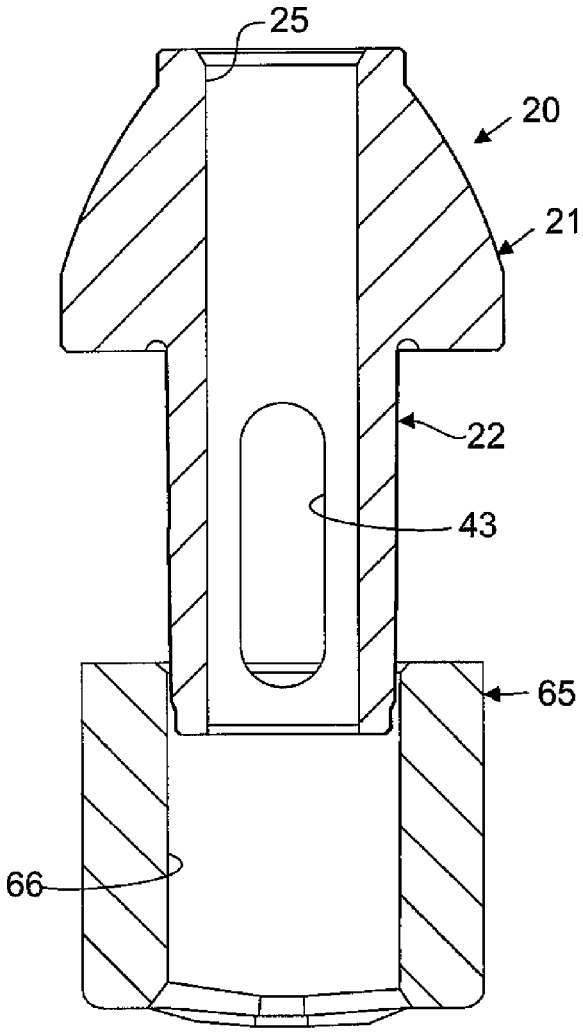
FIG. 13
FIG. 14
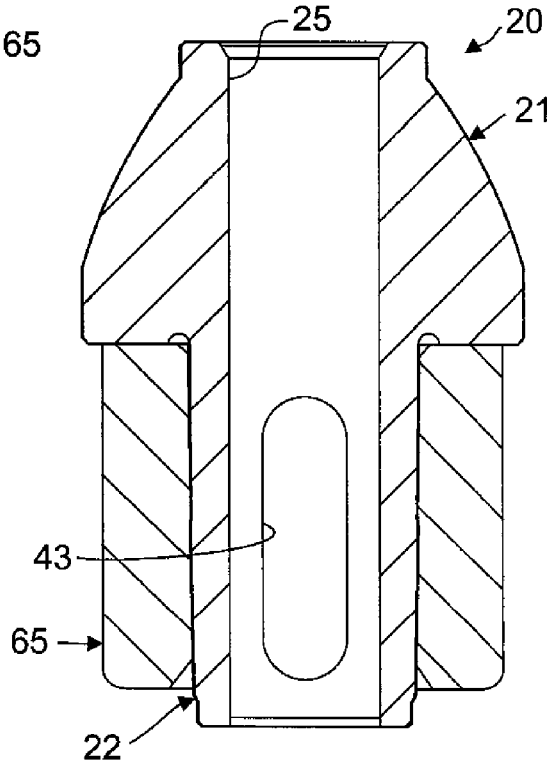

BIT HOLDER USABLE IN BIT BLOCKS HAVING EITHER OF A CYLINDRICAL OR NON-LOCKING TAPER BORE

This invention relates generally to road surface removal equipment, reclaimer-stabilizer equipment and mining equipment, and more particularly, to bit assemblies including bits, bit holders, and bit blocks that last longer than heretofore known such assemblies when in use in the field and provide for greater ease of replaceability, both when worn out and when broken in the field.

BACKGROUND OF THE INVENTION

Bit assemblies have long been utilized in road and highway milling machinery, as well as in off-road trenching equipment and in mining machinery. On such machinery, a plurality of bit assemblies are mounted both across the width and around the perimeter, sometimes in spiral or herringbone orientation, on the outside of a hollow rotary drum. Such bit assemblies are also utilized on the outside of a continuous chain, or similar endless looping machinery where the bits are moved through an orbit that is intercepted by the face of the road material being milled, the earth material from which a trench is being dug, and the material being mined.

The bit assemblies include a tip that has a working end and a shank. The shank is received in and may also be rotatably mounted in a bit holder that is secured, in turn, onto a bit block mounted (usually welded) on the outside of the drum. Bits typically have a hardened working end, preferably made of tungsten carbide or other hardened material, which impinges and digs into the surface it contacts to remove a portion of same. By utilizing a plurality of the bit assemblies around the outer surface of such a rotating drum or continuous chain, the amount of material removal in a given period of time may be substantial.

Since such road milling, trenching and mining machinery is considered heavy earth, coal, mineral or macadam moving machinery, substantial forces will operate on the bit assemblies in question. Engineers and operators of such equipment have long sought to extend the working life and decrease the down time of such equipment. A major breakthrough in the longevity of use of such equipment and in decreasing the time necessary to replace worn or broken bit assemblies used on such equipment was made by utilizing the bit assemblies shown and disclosed in U.S. Pat. No. 6,585,326 issued Jul. 1, 2003. That patent disclosed a bit assembly utilizing a bit holder that was held in place in its bit block without the necessity of utilizing a nut, retaining clip, bolt, or the like to maintain the bit holder in operative position in its bit block. By providing a bit holder with a generally cylindrical hollow shank having an elongate slot axially positioned through one side of the shank from the distal end thereof and extending toward the forward body portion of the shank, the bit holder was able to be pressed into a bore of the bit block such that the outer, generally cylindrical, radius of the shank was elastically collapsed an amount that was greater than the interference dimensions of a similarly sized solid shaft in a machined bore. It was found that the bit holder could be maintained in the bit block during operation, and be removed and replaced quickly by being driven out of its associated bit block without the need of removing retaining clips, threaded nuts or the like.

Additionally, the inventions disclosed in U.S. Pat. No. 7,097,258 issued Aug. 29, 2006 disclose a quick-change bit holder preferably having a slightly tapered shank with a pair of raised outer surfaces on a mediate portion along the length of the shank. The shank also includes a pair of diametrically opposed axially oriented slots extending along the shank through the mediate portion and immediately adjacent the raised outer portions of the shank on either side thereof. In this embodiment, unlike the embodiment first disclosed in U.S. Pat. No. 6,585,326, the dual opposed slots were totally internal in the shank and did not extend to the distal end of the shank. As such, the distal end of the shank provided more rigidity than the distal end of the shank disclosed in the '326 patent, but allowed enough deformation in the enlarged mediate portion of the shank, when pressed into a bit block to maintain the bit holder in a tapered bit block.

While the preferred embodiments shown in U.S. Pat. Nos. 6,585,326 and 7,097,258, were slightly (non-lockingly) tapered to the order of 1 degree or less per side, additional disclosures were made not only of tapered shanks, but shanks going from such a taper through and including a concave shape. Such shanks on either side of a strictly cylindrical shank, would be more efficient than a cylindrical shank in a cylindrical bore because the amount of surface contact, i.e., the driving interference distance, of such shanks would be less than the driving interference distance necessary for a completely cylindrical shank. However, such a cylindrical shape shank could work, although less efficiently and with more effort to insert or remove than the other preferred mentioned shanks.

The preferred bit blocks shown and utilized in the '326 patent include bores therethrough that are generally cylindrical with preferably a slight taper of 1 degree per side or less (preferably the same taper as the bit holder shank). Bit block bores that are completely cylindrical and also with 3½ degree per side taper have been utilized in bit assemblies. There are solid bit holder-bit block assemblies that are press fit assemblies.

A bit holder utilizing a substantial distal shank portion having a straight cylindrical outline and fitting into a bit block bore having a straight cylindrical bottom end with a slightly widened top end thereof is shown at U.S. Pat. No. 6,854,810.

a. Since the bases of all of the known such bit block assemblies are welded to either the outside of a generally cylindrical drum or welded to the outside of links of a chain or similar continuous looping mechanism, and since such bit blocks have substantially more metal material to withstand shock, wear and the like, and since base blocks are shielded by the frontal portion of the holder, bit blocks tend to have a much longer service life than bit holders or bits. As such, the bit holders and bits are made to be replaceable, and the more easily replaceable the better.

As mentioned previously, the use of a quick change type bit holder as disclosed in the '326 patent both lessens down time of its associated machinery, and the additional upper body material of such preferred bit holders lengthens the in-service life thereof.

The use of bit holders of differing bit blocks having both slightly tapered bit holder bores and partially cylindrical bit holder bores has heretofore meant that when one picked a drum, chain, or the like of one manufacturer, one was limited to that manufacturer's bit holders. Therefore, a need has developed for the construction of a bit holder that may be utilized in either existing type quick change style bit blocks.

SUMMARY OF THE INVENTION

It is therefore an object of the invention, generally stated, to provide a new and improved bit holder which may be utilized in bit blocks having bit block bores that are cylindrical along its entire length, or that are slightly constantly tapered along their length, and also bit block bores that are tapered along an upper portion thereof and cylindrical along a lower portion thereof.

Another object of the present invention is the provision of a bit holder shank that deflects sufficiently to allow the bit holder to be inserted and retained in a bit block bore that has a bottom portion thereof that is either a cylindrical or a non-locking taper in shape.

The invention resides in a bit holder for use in road milling, trenching and mining equipment as part of an assembly including a bit, bit holder and bit block. The bit holder comprises a front body portion and a generally cylindrical hollow shank portion extending from a rear of the front body portion. A generally cylindrical hollow shank portion defines an annular side wall and includes a first elongate slot radially through the side wall extending generally axially along the side wall from a distal end thereof and has a termination on the side wall between the distal end of the shank and the rear of the front body portion. A second internal elongate slot is positioned substantially spatially opposite the shank from the first elongate slot extends generally axially along the side wall with an upper termination spatially related to the rear of the front body portion, and a lower termination spatially related to the distal end of the shank. At least portions of said shank having a free standing diametrical dimension that is larger than a corresponding diametrical dimensions of one of a cylindrical bit block bore, and a non-locking tapered bit block bore and the insertion of the bit holder shank in the bit block bore provides sufficient outward radial force by radial deflection of the portions of said shank adjacent said slots to retain the shank in the bit block bore during use.

BRIEF DESCRIPTION OF THE DRAWINGS

The features of the present invention which are believed to be novel are set forth with particularity in the appended claims. The invention may best be understood from the following detailed description of a currently preferred embodiment and modifications thereof taken in conjunction with the accompanying drawings wherein like numerals refer to like parts, and in which:

FIG. 13 is a cross-sectional diagrammatic view of the bit holder of the first embodiment as it appears at the start of its insertion into a bit block having a slight (1 degree per side) constant taper; and FIG. 14 is a cross-sectional diagrammatic view of the bit holder of the first embodiment fully inserted into the bit block shown in FIG. 13.

DETAILED DESCRIPTION OF THE PREFERRED EMBODIMENTS

Figure 1:
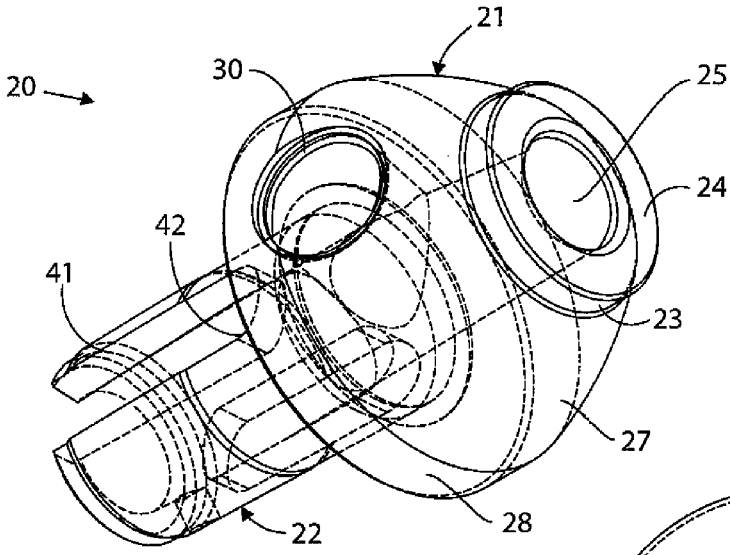
FIG. 1 is a ¾ front perspective view of a the bit holder, constructed in accordance with the present invention, that may be utilized in both constantly tapered and partially cylindrical bit block bores.
Figure 2:
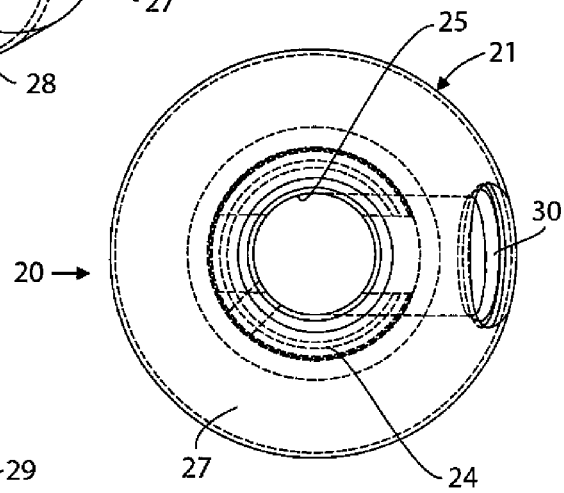
FIG. 2 is a top plan view of the body of the bit holder shown in FIG. 1.
Figure 3:
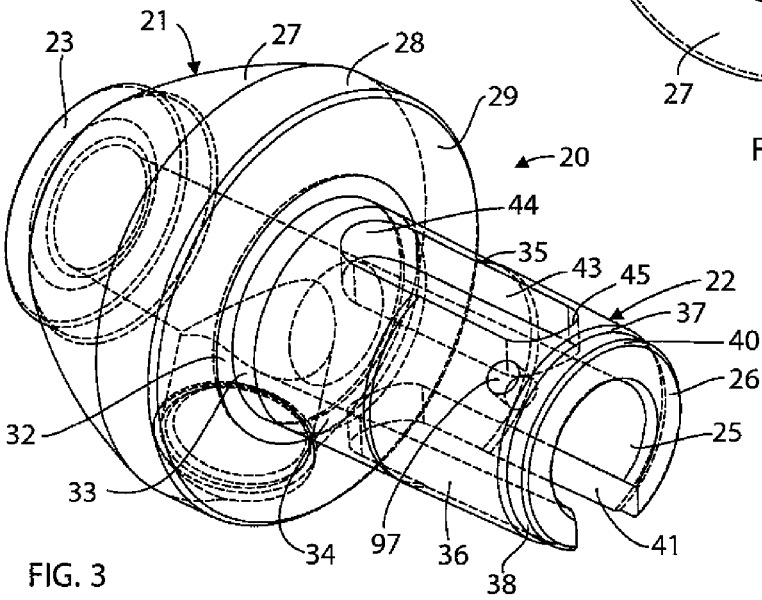
FIG. 3 is a bottom ¾ perspective view of the bit holder shown in FIG. 1 emphasizing the construction of the shank thereof.

Referring to FIGS. 1, 2 and 3, a bit holder, generally indicated at 20, and preferably made of a 4100 or 8600 series steel with at least 0.30 carbon content, or one that produces similar compression and tensile strength, includes a front body portion 21 and a generally cylindrical shank 22 extending from the rear of the front body portion. As with previous bit holders made by the assignee of the applicant, the front body portion 21 includes a leading annular ring 23 or shoulder having a generally flat front annular surface 24 and a central bore 25 extending from that front surface through the body portion 21 and axially through the length of the shank 22 to the distal end 26 of the shank 22. The diameter of bore 25, in this preferred embodiment, which is meant for use in road milling equipment, approximates 0.782 inch. The expanded outer diameter of a retainer on a bit shank (not shown) is about 0.050 inch larger than the bit holder bore. The shank of the bit that fits in this holder central bore 25 when used on road milling equipment is 0.665 inch in diameter. The retainer attaches to the shank of the bit and has a wall thickness of generally 0.045 inch. Mining bit shanks approximate 1 inch, 1 3/16 inch, 1 3/8 inch and 1 1/2 inch in diameter. Trenching bit shanks approximate 1 3/16 and 1 1/2 inch in diameter. Other sizes may also be utilized.

One of the features of the bit holder front body portion 21 is to provide substantial bulk along with a fairly streamlined outer surface, both to allow removed product to slide or slip by the sides of the bit, bit holder, and block, as well as to provide shoulder bulk to resist wear and extend the working life of this heavy duty equipment. As such, in the preferred embodiment, axially rearwardly of the front leading ring 23, is a generally frustoconical portion 27 that widens as one proceeds axially along the length of the front body portion toward the shank 22 thereof until one comes to an outer rear portion of the body that is annular or cylindrical in shape, and is denoted in the industry as the "tire" portion 28. In this embodiment the body portion is 2.00 inches long and the shank is 2.58 inches long, although other uses, such as mining and trenching utilize differing size equipment. As shown most clearly in FIG. 3, the rear of the outer tire portion 28 includes a generally rearwardly facing flat annular flange 29.

In this preferred embodiment 20, a side hole generally indicated at 30, which is the subject of co-pending application Ser. No. 11/998,676, filed Nov. 30, 2007, extends inwardly from the outside of frustoconical portion 27 and a part of the tire portion 28 of the bit holder body 21 at an acute angle toward the axis of the bit holder bore 25. The side hole 30 is the same diameter as the bit holder bore 25 and is used in connection with a slide hammer removal tool assembly that is the subject matter of co-pending application Ser. No. 12/193,866 filed Aug. 19, 2008. A cylindrical plug, such as shown at 147 in FIG. 6 fits in the side hole, although it may be left open in operation, further, if desired, a 0.750 inch nominal cylindrical plug may be utilized, as may a bit (not shown), since they are approximately the same diameter. The slide hammer (not shown) utilizes a central threaded shaft and a hook threaded thereon that includes a 0.750 inch cylindrical pin or plug at its distal end that is canted to fit in the side hole 30. The central shaft is inserted in the bit holder bore until it impinges on the pin. The slide hammer then acts on a stop member on the opposite end of the shaft to provide sufficient axial impact force to manually remove the bit holder from the bit block. Pneumatic pressure is not required, making field changes and repairs quicker and easier than heretofore known.

While the shank 22 extends axially rearwardly from the rear face 29 of the front body portion, the preferred embodiment 20 includes a recess 32 partially formed in the annular rear face 29 and 33 partially formed in the outer surface of the shank 22 adjacent and in continuation of recess 32, provides a round, less stress, joinder between the shank 22 and front body portion 21.

Shank 22 extends in the preferred embodiment from the back annular face recess 32 to the distal end 26 of the shank. Shank 22 is generally cylindrical in shape a nominal diameter of 1.545 inch, although, this preferred embodiment includes two slightly tapered surfaces, the first generally annular surface extends from recess 32 and tapers slightly at 34 axially along the shank until it reaches a raised generally annular shoulder 35 which raises the outer diameter of the shank approximately 0.015 inch on the diameter and begins a second taper portion 36 that extends from the shoulder 35 to a chamfer 37 that extends to a slightly reduced diameter distal end portion 38 which extends to another chamfer 40 that meets distal end flat surface 26.

In one important aspect of the present invention, the hollow generally cylindrical shank that not only includes an elongate slot 41 that extends from the distal end 26 of the shank axially through the outer wall of the shank to a position at 42 which is close to but spatially adjacent from recess 32. In the preferred embodiment, the distance is about ⅜ inch. Along with the elongate first slot is, in this preferred embodiment, an elongate second totally internal slot 43 that extends completely through the side wall of the shank in a diametrically opposed position from elongate slot 41. Slot 43, while elongate, is completely enclosed within the shank in that it has opposed upper end portion 44 which is positioned axially along the shank a like distance from recess 32 to that of the lower end portion 45 of slot 41 .

It has been found that narrowing or slightly widening the 9⁄16 inch wide first slot 41 does not significantly change the radial force exerted by the shank on the bit block bore when the outer diameter 22 and inner diameter 25 remain constant, as much as the addition of the second slot 43. Varying the length of the second slot allows one to fine tune the radial force. For example, a larger trenching machine bit holder will have a shorter second slot to increase the radial force of the bit holder on the bit block.

A second or opposing enclosed end portion 45 is positioned axially adjacent, but spatially related to the chamfer 37 such that slot 43 is completely surrounded by the shank, unlike slot 41. Slot 43 also extends across the shoulder 35 and in this embodiment is approximately 120 percent the length in the first tapered portion 34 and approximately 140 percent the length in the second tapered portion 36. The combination of the first and second elongate slots provides for more elastic deformation in the shank than in the embodiment shown in the '326 patent, while allowing for deformation at the distal end of the shank that is not contemplated in the dual slotted embodiment of the '258 patent. Additionally, the slight elastic deformation capability of the shank 22 of the first embodiment is more symmetrical in its deformation because of the dual opposing slots 41 and 43 than the radial deformation in the single slot shown in the '326 patent when it is inserted into a bit block bore, as will be discussed in more detail below. The provision of the second slot means the beam strength, radial force and frictional force between the bit holder shank and bit block bore may all be adjusted as necessary to maximize the fit between the two members. Likewise, increasing the bit holder bore increases the radial deflection and reduces the beam strength thereof during the insertion of the bit holder shank in the bit block.

Additionally, a locator pin hole 47 extends through the side wall of shank 22 to complete the disclosure of the physical structure of the first embodiment 20 of the present invention.

On mining equipment and trenching equipment, the shank of a bit holder will be larger than that for road milling equipment and will approximate a range of 1 to 1½ inches in nominal cylindrical diameter. These are sizes presently in use and it will be appreciated that other sizes may also be utilized within the present invention, especially as equipment having greater processing capacity is desired by end users.

Figure 4:
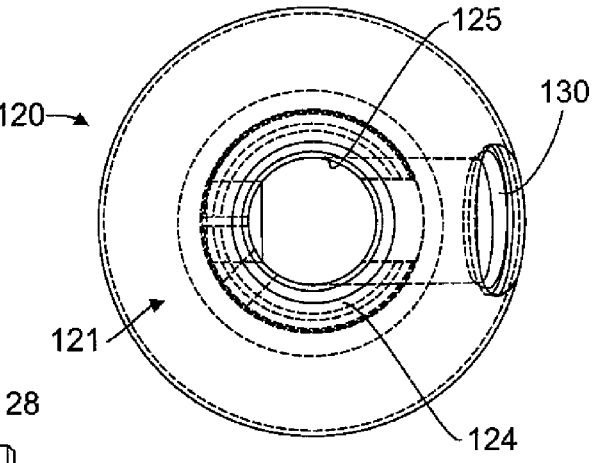
FIG. 4 is a top plan view of a first modification of a bit holder constructed in accordance with the present invention.
Figure 5:
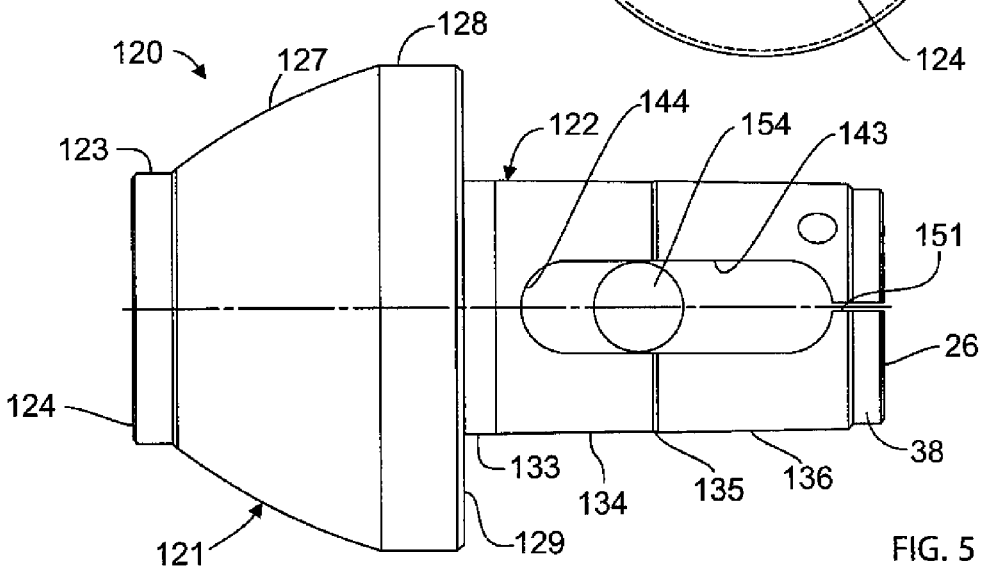
FIG. 5 is a side elevational view of a back side of the bit holder shown in FIG. 4.
Figure 6:
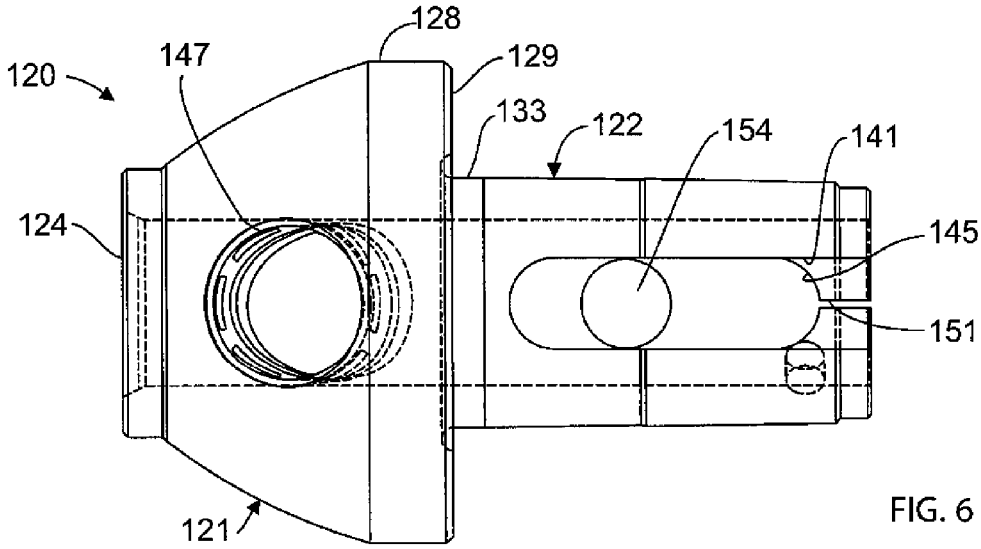
FIG. 6 is a front side elevational view of the bit holder modification shown in FIG. 4.

Referring to FIGS. 4, 5 and 6, a first modification of the present invention, generally indicated at 120, is constructed identically with that of the first embodiment 20 with a few exceptions. Therefore, the numbers used to indicate the various structural portions of the first embodiment are used, with the addition of the numeral 1 in front thereof (the hundreds position), to identify the identical portions of the first modification.

FIG. 6 shows a plug 147 (shown in outline) that fits in the side hole 30, 130, etc. of all the embodiments shown in this application. The main difference between the first embodiment 20 and the first modification 120 of the present invention is the provision of a narrow slot 151-151*a* that extends from the lower terminus 145 of the internal slot 143 of the second embodiment to the distal end 126 of the shank portion 122. In the preferred embodiment, this slot is approximately 0.035 inch wide and may be formed by a band saw or the like. In operation, when a shank of a bit holder 120 is pressed into a bit block bore, both the elongate slot 141 and the slot 151-151*a* of the second embodiment tend to close up or become smaller. While slot 141 is sufficiently large that it will not totally close, slot 151-151*a* is specifically formed with sides that are closer together so that at some point during the insertion, the sides of slot 151 may become contiguous, or meet, and that side of the distal end 126 of the shank 122 will thereafter act as a solid joined member.

The preferred use for bit holders of the first modification 120 is in lower horse-power machines where the radial force necessary to retain the bit holder in the bit block is less than in the first embodiment 20. The construction allows the insertion and removal to be accomplished with less force than the first embodiment.

A second difference between the first embodiment 20 and the first modification 120 resides in a generally cylindrical plug 154 that is press fittable within the internal slot 143 (9⁄16 inch in this embodiment), and the elongate slot 141 if desired, and is capable of acting on the side walls of the slot to inhibit further collapsing of the diameter of the side wall of the shank at a location anywhere along the length of the slot where the plug is press fit therein. The material and hardness of the cylindrical plug 154 may be varied to achieve desired results in limiting the collapsibility of the slot 143 and therefore, the collapsibility of the bit holder shank diameter. The position of the plug 154 along the internal slot 141 may also be varied to achieve desired results.

Figure 7:
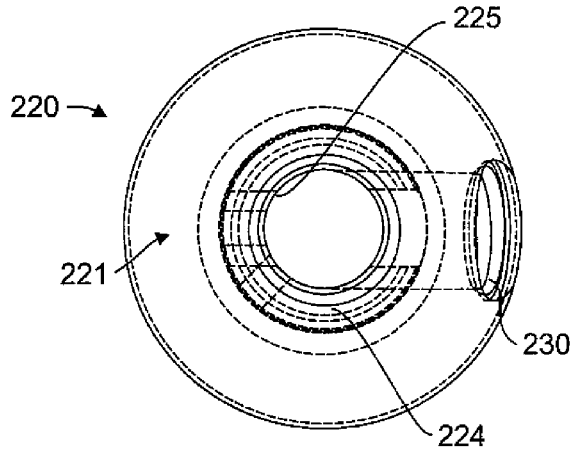
FIG. 7 is a top plan view of the body portion of a second modification of the bit holder constructed in accordance with the present invention.
Figure 8:
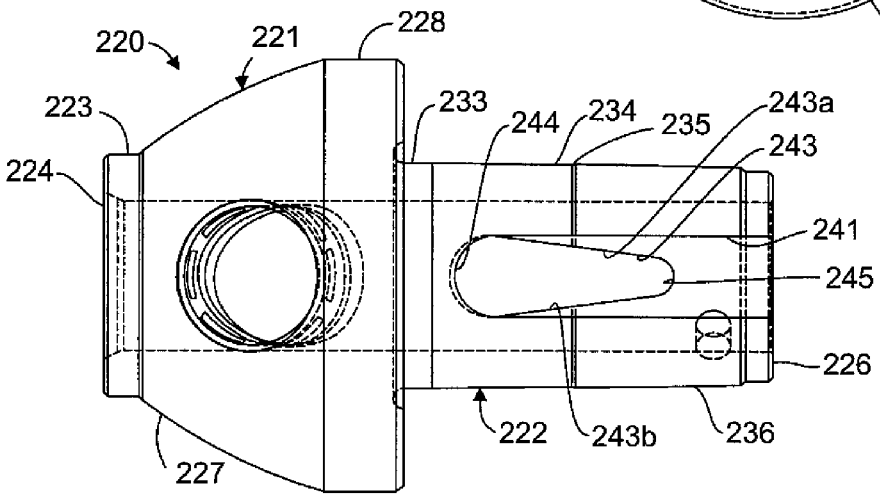
FIG. 8 is a front elevational view of the bit holder shown in FIG. 7.
Figure 9:
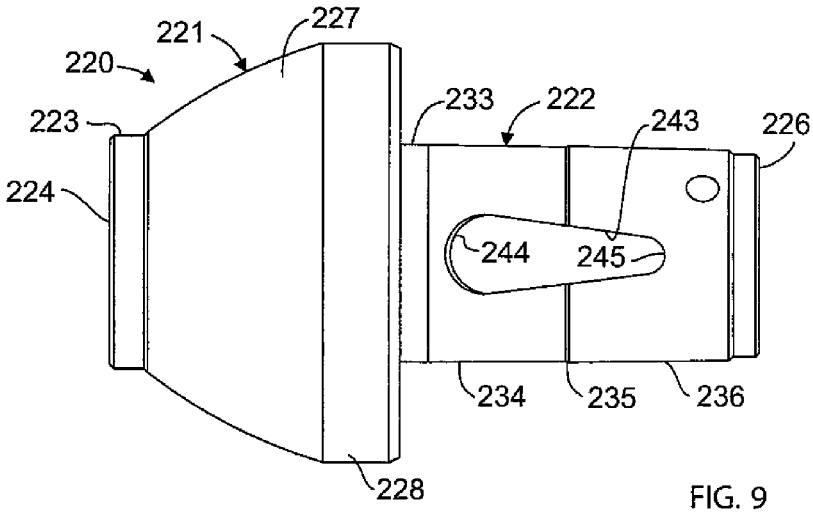
FIG. 9 is a back elevational view of the bit holder shown in FIG. 7.

Referring to FIGS. 7, 8 and 9, a second modification of the bit holder of the present invention is shown generally at 220. As with the first modification, the second modification is identical to that of the first embodiment 20 bit holder with a single exception being the shape and length of the second elongate internal slot 243 that is positioned diametrically opposite the elongate slot 241 in shank 222. As with the first modification, the second modification includes the same singles and tens numerals used in the first embodiment with the addition of a numeral 2 in front of that number (the hundreds position).

As with the first embodiment, the internal elongate slot 243 is found completely within the bounds of generally cylindrical shank 222. It is also preferably diametrically opposite first elongate slot 241 and in the second modification, slot 243 has generally converging elongate sides 243*a* and 243*b*. The top terminus of slot 244 is, in this preferred embodiment, the same width and shape as the top terminus 44 of the first embodiment.

The bottom internal terminus 245 of the second modification has a smaller radius than that of top terminus 244 where it meets the converging sides 243*a*, 243*b*. The use of a slot shaped as slot 243 in the second modification 220 of the bit holder provides for a stiffer second tapered portion of the bit holder shank 236 than found in the second tapered portion 36 of the first embodiment of the bit holder. In other words, by varying the width of the internal slot 243 along its length, the stiffness of the side wall of the shank may be varied in accordance with desired characteristics. Changing the width of the internal slot as shown in the second modification may have similar effects in the second modification as putting the cylindrical press fit plug 154 in the slot 143 of the first embodiment in a position lower, more toward the distal end, of the shank.

Figure 12:
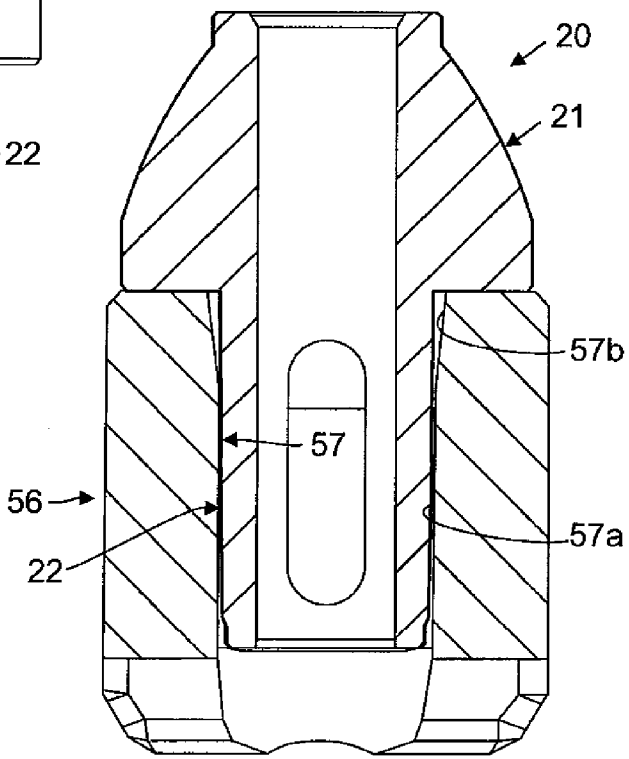
FIG. 12 is a cross-sectional diagrammatic view of the bit holder of the first embodiment shown as it appears after insertion in the bit block bore of a bit block including both an upper tapered section and a lowered cylindrical section thereof.
Figure 11:
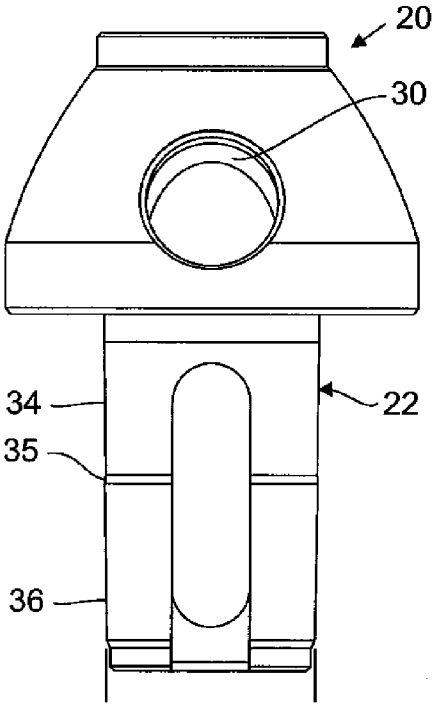
FIG. 11 is a front elevational view of the bit holder of the first embodiment showing the shank outside dimensions as they are after insertion into a partly tapered and partly cylindrical bit block.
Figure 10:
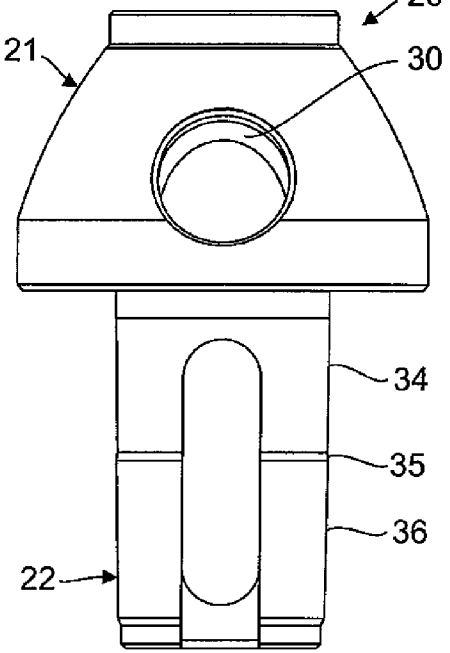
FIG. 10 is a front side elevational view of the bit holder of the first embodiment showing its outside shank dimensions prior to being inserted in a bit block.

Referring to FIGS. 10, 11 and 12, and specifically to FIG. 12, a bit holder of the first embodiment 20 is shown as it appears when inserted in a bit block bore 57 of bit block 56 that is completely cylindrical at 57*a* toward the bottom end of the bore and tapered outwardly at 57*b* at about a 5½ degree angle per side toward the top of the bit block bore 57.

Referring to FIGS. 13 and 14, the use of a slight taper in both the bit block bore 66 of bit block 65 and the outer surface of the bit holder shank 22 allows the bit holder shank to be inserted within the bit block bore 66 for a greater distance before contacting with mating surfaces. The tapered surface of the bit holder shank 22 contacts the bit block bore 66 in the last approximately ⅝ inch of travel and is snug therein over that short distance, rather than being pressed for the entire length of the lower cylindrical portion of the bit block bore shown in FIG. 12.

Heretofore, bit holders having a completely cylindrical lower distal end portion of its shank have not been able to be inserted in a bit block bore having a constant tapered bore such as at 66, and conversely, a generally cylindrical but slightly tapered bit holder shank has not been insertable in the bit block bore of a bit block having a completely cylindrical lower portion together with a widening tapered top portion.

FIG. 10 shows the outer shank dimensions of the shank 22 of the first embodiment 20 at three portions along its length, measured with the bit holder in its uninserted relaxed position.

FIG. 11 shows those dimensions at the same shank positions as they exist when the bit holder of the first embodiment 20 is completely inserted in the bit block 56 as shown in FIG. 12. The use of the second internal slot 43 together with the elongate first slot 41 in preferred diametrically opposed position on the bit shank 22 enables the bit holders 20, 120, 220 of the present invention to be utilized in all presently existing configurations of quick change type bit blocks found in the industry.

As such, purchasers and users of mining, road milling and trenching equipment utilizing such bit assemblies are not limited to the maker of the individual assemblies that were purchased with the mining, milling or trenching equipment. Replacement bit holders may be purchased by others than those who made the original equipment and may be utilized to provide, in some cases, even easier insertion and removability of the bit holders and bits in connection with using the equipment, together with longer wear times which are a product of the added bulk of the bit holder shown in the instant application.

Referring to FIGS. 10, 11 and 12, the insertion of a bit holder, such as that shown at 20, into a bit block 56 that has both tapered 57*b* and cylindrical 57*a* portions actually is inserted and removed with less force than that used with a bit holder having a cylindrical distal end portion, as presently known. This is because the contact distance and radial exerted forces of interference are less. In the bit block 56 of FIG. 12, the annular contact zone of the inserted shank 22 approximates ½ inch below the step up portion 35 of shank 22, with a ⅛ inch space of no contact above the step up portion, and a second annular zone of contact ¼ inch above that space. While the contact zones are not perfectly consummated, they provide sufficient radial force between the bit holder shank and bit block bore to maintain the bit holder in the bit block during use.

In considering how applicant's invention works, explanation has been made referring to interference fits or press fits, which relate to fitting a solid cylinder into a cylindrical holder bore that is somewhat smaller than the outside of the solid cylinder. However, the present invention utilizes a hollow generally cylindrical shank that has not one, but two differing slots in the side of the shank. Standards for interference fits are found in engineering handbooks, so the terms and dimensions of those standards are used as references. But no such standards exist in the machinery world for what is accomplished by the present invention, or applicant's prior inventions on this subject matter.

In a standard press fit, the dimensions of the solid cylindrical shaft and the cylindrical bore both slightly change to allow for the press fit. In applicant's invention, utilizing a hollow cylinder that is slotted, the majority of the radial deflection changes in the slotted region. As shown by experimentation, the deflection of that hollow slotted cylinder is greater than the deflection of a solid cylinder in a standard press fit, at least about 4 times as much. However, the goal of the present invention is similar to the goal achieved by a standard press fit, i.e., to provide sufficient radial force between the cylinder and the bore to maintain the cylinder mounted in the bore. By utilizing dimensional differences that are much greater than that of standard interference of press fits, dimensional tolerances are increased and parts become less expensive to make. Therefore, the advantages of applicant's invention are multiple-fold over prior technology involving this subject matter.

These larger (and less expensive to produce) dimensional differences mean that changes in the above noted bit holder dimensions can be readily accomplished to provide quick change type bit holders usable in completely cylindrical bit block bores, and also in bit block bores that have other tapers, such as 3½ degrees per side. The use of the back face of the bit holder body to seat on the bit block top surface means that seating need not take place between the holder shank and the bit block bore. A complete matching fit between the shank and bore is not necessary, as shown in FIG. 12. The flexible center portion of the shank side wall, as a result of the two slots, may be manipulated from an engineering standpoint to provide for retention of the bit holder in the bit block for numerous configurations. Additionally, the wall thickness of the central portion of the bit holder shank may be manipulated to provide differing radial force parameters in the quick change unit.

While one embodiment, and two modifications of the present invention have been shown and described, it will be apparent to those skilled in the art that many changes and modifications may be made without departing from the true spirit and scope of the present invention. It is the intent of the appended claims to cover all such changes and modifications which fall within the true spirit and scope of the invention

What is claimed is:

1. A bit holder for use in road milling, trenching and mining equipment as part of an assembly including a bit, bit holder and bit block, with said bit block having a bit block bore that is one of: a) cylindrical, b) non-locking tapered and c) a combination of a non-locking tapered bore on a top portion of said bit block bore and a cylindrical bore on a bottom portion of said bit block bore, said bit holder comprising;

a front body portion and a generally cylindrical hollow shank portion extending from a rear of said front body portion, said generally cylindrical hollow shank portion defining an annular side wall and including a first elongate slot radially through said side wall extending generally axially along said side wall from a distal end thereof and having a termination on said side wall between said distal end of said shank forward end of said shank, a second internal elongate slot substantially diametrically opposite said shank from said first elongate slot, said second slot extending generally axially along said side wall with an upper termination spatially related to said rear of said front body portion, and a lower termination spatially related to said distal end of said shank, and a third slot, narrower than said second slot and extending between said lower termination of said second slot and said distal end of said shank;

at least portions of said shank having a free standing diametrical dimension, larger than a corresponding diametrical dimension of said bit block bore, and the insertion of said bit holder shank in said bit block bore providing sufficient outward radial force by radial deflection of said portions of said shank to retain said shank in both said bit block cylindrical and non-locking tapered bores during use.

2. The bit holder as defined in claim 1, wherein a width of said third slot is dimensioned to close said third slot upon insertion of said bit holder shank in said bit block bore.

3. The bit holder as defined in claim 1 wherein a longer said second slot has increased diametrical deflection adjacent said slot and a shorter said second slot has decreased diametrical deflection adjacent said second slot.

4. The bit holder as defined in claim 1 wherein at least a portion of said bit holder bore adjacent said slots is diametrically increased to increase the radial deflection and reduce the beam strength thereof during the insertion of said bit holder shank in said bit block.

* * * * *